US007599643B2

(12) United States Patent
Takamatsu

(10) Patent No.: US 7,599,643 B2
(45) Date of Patent: Oct. 6, 2009

(54) IMAGE FORMING APPARATUS HAVING ELECTRODE CLEANING MEMBER

(75) Inventor: Naritoshi Takamatsu, Kyoto (JP)

(73) Assignee: Murata Machinery, Ltd., Kyoto (JP)

( * ) Notice: Subject to any disclaimer, the term of this patent is extended or adjusted under 35 U.S.C. 154(b) by 0 days.

(21) Appl. No.: 11/961,231

(22) Filed: Dec. 20, 2007

(65) Prior Publication Data

US 2008/0151272 A1 Jun. 26, 2008

(30) Foreign Application Priority Data

Dec. 21, 2006 (JP) ..... 2006-344581
Dec. 21, 2006 (JP) ..... 2006-344582

(51) Int. Cl.
*G03G 15/02* (2006.01)
*G03G 21/00* (2006.01)

(52) U.S. Cl. ..... 399/100; 250/324; 399/170

(58) Field of Classification Search ..... 399/100, 399/99, 101, 170, 171, 172; 250/324, 325, 250/326; 361/229, 230
See application file for complete search history.

(56) References Cited

U.S. PATENT DOCUMENTS 5,012,093 A * 4/1991 Shimizu ..... 399/100
5,089,850 A * 2/1992 Ogura et al. ..... 399/99
5,532,798 A 7/1996 Nakagami et al.
2004/0013443 A1* 1/2004 Itoh et al. ..... 399/100

FOREIGN PATENT DOCUMENTS

JP 54-104833 A 8/1979
JP 03-089267 A * 4/1991
JP 05-297688 A 11/1993
JP 05-323772 A 12/1993
JP 8-190255 A 7/1996
JP 09-119499 A 5/1997
JP 9-190051 A 7/1997
JP 2003-076114 A 3/2003
JP 2006-317789 A 11/2006
JP 2006-330115 A 12/2006

OTHER PUBLICATIONS

Machine translation of JP 09-190051 dated Nov. 16, 2008.*
Official communication issued in counterpart European Application No. 07024858.8, mailed on Apr. 16, 2008.
Official communication issued in counterpart Japanese Application No. 2006-344581, mailed on Jul. 22, 2008.
Official communication issued in the counterpart Japanese Application No. 2006-344581, mailed on Jun. 16, 2009.

* cited by examiner

*Primary Examiner*—Sophia S Chen
(74) *Attorney, Agent, or Firm*—Keating & Bennett, LLP

(57) ABSTRACT

An image forming apparatus includes a corona discharger including: a stylus electrode; and a cleaning member capable of slidably moving along a longitudinal direction of the stylus electrode in the state that the stylus electrode is sandwiched in the cleaning member, wherein the cleaning member includes: a movable body attached to a case section of the corona discharger so as to be movable along the longitudinal direction of the stylus electrode; a first slidably-contacting member and a second slidably-contacting member which are supported by the movable body and between which the stylus electrode is inserted; and an urging unit interposed between the movable body and the first slidably-contacting member so as to elastically urge the first slidably-contacting member to the second slidably-contacting member.

2 Claims, 7 Drawing Sheets

IMAGE FORMING APPARATUS HAVING ELECTRODE CLEANING MEMBER

CROSS-REFERENCE TO RELATED APPLICATIONS

This application claims priority under 35 U.S.C. 119 to Japanese Patent Application No. 2006-344581, filed on Dec. 21, 2006, and Japanese Patent Application No. 2006-344582, filed on Dec. 21, 2006, which applications are hereby incorporated by reference in their entirety.

BACKGROUND OF THE INVENTION

1. Field of the Invention

The present invention relates to an image forming apparatus having an electrophotographic image-forming process section, and more particularly, to improvements in a cleaning member in a corona discharger constituting the image-forming process section.

2. Description of the Related Art

An image forming apparatus having an electrophotographic image-forming process section is frequently used in a copier, a facsimile, a printer, a so-called multifunction machine having their features, and the like. A corona discharger is incorporated as one constituent member of such an image-forming process section. The corona discharger is used for a charging device for uniformly charging the surface of a photosensitive drum, a transfer device for transferring a toner image on the surface of the photosensitive drum to a recording medium (recording paper), and a discharging device for discharging from the surface of the photosensitive drum. Although a wire electrode has previously been used as an electrode of the corona discharger, the electrode presents a problem of generation of ozone. A stylus electrode which generates smaller amounts of ozone has come into extensive use.

Although the corona discharger using the stylus electrode is preferable as a charging device constituting an image-forming process section, such as that mentioned above, because of generation of small amounts of ozone, the stylus electrode is apt to attach extraneous matters (toner, paper dust, silicon, or the like) over time. When an increase arises in the amounts of attached matters, irregularities occur in electric discharge, which cause a failure in formation of an image in some cases. For this reason, as described in Japanese Patent Publication No. H07-43990, a corona discharger having a cleaning device which enables sweeping of a surface of the stylus electrode, as appropriate, has already been put into practical use. The cleaning device of the corona discharger disclosed in Japanese Patent Publication No. H07-43990 is configured in such a way that a stylus electrode is sandwiched between a pair of rotatably-supported rollers and that the pair of rollers can be slidably moved, while sandwiching the rollers, along a longitudinal direction of the stylus electrode.

Incidentally, in the cleaning device such as that described in Japanese Patent Publication No. H07-43990, both shaft sections supporting the pair of rollers are biased in a direction to face each other. Therefore, the rollers are rotated in the state that an urging load remains exerted on both surfaces of the stylus electrode. Accordingly, the load acts so as to impede rotation of both rollers, and sliding resistance also becomes great. In order to lighten such a load that impedes rotation of the rollers, support shafts must be arranged to support the rollers by way of a bearing member or a bearing member must be arranged to support a rotary shaft integrated with the rollers, to thus cause the bearing member to support the load.

However, such a structure results in the necessity of providing a bearing member to both rollers, which leads to an increase in the number of components.

A conceivable way to prevent an increase in the number of components is to combine a shaft-rotational slidably-contacting member (a roller) with a non-rotational slidably-contacting member; to exert urging load only on the non-rotational slidably-contacting member; to insert a stylus electrode between the members; and to slide the members, thereby cleaning the stylus electrode. In this case, since the load is not exerted directly on the shaft-rotational slidably-contacting member, a bearing member for lessening the load that impedes rotation is obviated, and superior cleaning function is achieved without involvement of an increase in the number of components, and an enhanced practical value is expected to be attained. However, when both members are caused to perform nipping and when the members are slidably moved in the state that the stylus electrode is inserted in the nipped section, it may be the case where a stylus portion of the stylus electrode will catch a slidable-contact surface of the non-rotational slidably-contacting member, whereupon the stylus electrode is bent.

SUMMARY OF THE INVENTION

In order to overcome the problems described above, preferred embodiments of the present invention provide an image forming apparatus having a corona discharger capable of efficiently performing a cleaning operation without any increase in the number of components and which prevents catching of a stylus electrode incident to the cleaning operation.

According to a preferred embodiment of the present invention, an image forming apparatus including a corona discharger includes: a stylus electrode; and a cleaning member capable of slidably moving along a longitudinal direction of the stylus electrode in the state that the stylus electrode is sandwiched in the cleaning member, wherein the cleaning member includes: a movable body attached to a case section of the corona discharger so as to be movable along the longitudinal direction of the stylus electrode; a first slidably-contacting member and a second slidably-contacting member which are supported by the movable body and between which the stylus electrode is inserted; and an urging unit interposed between the movable body and the first slidably-contacting member so as to elastically urge the first slidably-contacting member to the second slidably-contacting member.

In a preferred embodiment of the present invention, the first slidably-contacting member preferably includes a non-rotational member which is supported by the movable body so as to be movable toward the second slidably-contacting member and non-rotatable; and the second slidably-contacting member preferably includes an axially-rotational member supported by a bearing section of the movable body so as to be axially rotatable. Moreover, the corona discharger can be embodied as a charging device for charging a surface of the photosensitive drum constituting the image-forming process section.

An image forming apparatus according to a preferred embodiment of the present invention corresponds to an image forming apparatus having a corona discharger, wherein the corona discharger has a case section, a stylus electrode stretched within the case section, and a cleaning member capable of slidably moving along a longitudinal direction of the stylus electrode such that the stylus electrode is sandwiched in the cleaning member; the cleaning member has a movable body attached to the case section of the corona discharger so as to be movable along the longitudinal direction of the stylus electrode, a combination of an non-rotational slidably-contacting member and an axially-rotational slidably-contacting member which are respectively supported by the movable member between which the stylus electrode is sandwiched, and an urging unit interposed between the movable body and the non-rotational slidably-contacting member so as to elastically urge the non-rotational slidably-contacting member to the axially-rotational slidably-contacting member; and positions of the two slidably-contacting members are set in such a way that a nip section between the two slidably-contacting members becomes slightly close to the non-rotational slidably-contacting member with reference to a tension line of the stylus electrode.

In a preferred embodiment of the present invention, the non-rotational slidably-contacting member can be supported by the movable body so as to be movable toward the axially-rotational slidably-contacting member and non-rotatable, and the axially-rotational slidably-contacting member can be supported by a bearing section of the movable body so as to be axially rotatable. Moreover, the corona discharger can be embodied as a charging device for charging a surface of the photosensitive drum constituting the image-forming process section.

In the image forming apparatus according to a preferred embodiment of the present invention, the corona discharger has a stylus electrode and a cleaning member. The cleaning member is capable of slidably moving along a longitudinal direction of the stylus electrode. The stylus electrode is sandwiched in the cleaning member. Hence, the stylus electrode is cleaned by slidably moving the cleaning member in the longitudinal direction of the stylus electrode. The cleaning member has a movable body attached to the case section of the corona discharger so as to be movable along the longitudinal direction of the stylus electrode, two slidably-contacting members which are supported by the movable body and between which the stylus electrode is sandwiched, and an urging unit interposed between the movable body and the slidably-contacting member so as to elastically urge the one slidably-contacting member to the other slidably-contacting member. Therefore, the movable member is reciprocally moved such that the one slidably-contacting member is elastically biased toward the other slidably-contacting member by the biasing unit. As a result, both surfaces of the stylus electrode are elastically sandwiched, whereby toner, silicon, or the like, is effectively wiped off. A load is exerted on only one of the slidably-contacting members, and sliding resistance is not increased, and both slidably-contacting members do not need to be provided with a bearing member arranged to receive a load for lightening the load, and an increase in the number of components is not incurred.

The one slidably-contacting member preferably includes a non-rotational member which is supported by the movable body so as to be movable toward the other slidably-contacting member and non-rotatable, and the other slidably-contacting member preferably includes an axially-rotational member supported by a bearing section of the movable body so as to be axially rotatable. In this case, a load is exerted on the non-rotational member, and an urging load is not exerted directly on the axially-rotational member. Therefore, the bearing section which supports the axially-rotational member in an axially-rotatable manner does not need to be provided with another member for eliminating an obstruction to rotation of the axially-rotational member, which is more effective for curtailing the number of components.

In the image forming apparatus according to a preferred embodiment of the present invention, the corona discharger has a stylus electrode, and a cleaning member capable of slidably moving along a longitudinal direction of the stylus electrode. The stylus electrode is sandwiched in the cleaning member. Hence, the stylus electrode is cleaned by slidably moving the cleaning member in the longitudinal direction of the stylus electrode. The cleaning member has a movable body attached to the case section of the corona discharger so as to be movable along the longitudinal direction of the stylus electrode, a combination of an non-rotational slidably-contacting member and an axially-rotational slidably-contacting member which are respectively supported by the movable member between which the stylus electrode is sandwiched, and an urging unit interposed between the movable body and the non-rotational slidably-contacting member so as to elastically urge the non-rotational slidably-contacting member to the axially-rotational slidably-contacting member. Therefore, when the movable member is reciprocally moved while the stylus electrode is sandwiched between the slidably-contacting members, the movable member is reciprocally moved in the state that the biasing unit elastically bias the non-rotational slidably-contacting member to the axially-rotational slidably-contacting member. As a result, both surfaces of the stylus electrode are elastically sandwiched, whereby toner, silicon, or the like, is effectively wiped off. A load is arranged so as to be exerted on only the non-rotational slidably-contacting member, and sliding resistance is not increased, and both slidably-contacting members do not need to be provided with a bearing member arranged to receive a load for lightening the load, and an increase in the number of components is not incurred.

The position of the non-rotational slidably-contacting member and the position of the axially-rotational slidably-contacting member are set in such a way that a nip section between the two slidably-contacting members becomes slightly close to the non-rotational slidably-contacting member with reference to a tension line of the stylus electrode. Accordingly, at the time of reciprocal movement of the movable member, the possibility of needle-shaped electrodes of the stylus electrode being guided to the nip section from the non-rotational slidably-contacting member is reduced. Therefore, the possibility of the stylus electrode being bent due to the needle portions being caught by the non-rotational slidably-contacting member is reduced. Incidentally, the possibility of the stylus electrode being guided to the nip section from the axially-rotational slidably-contacting member becomes higher. However, the axially-rotational slidably-contacting member axially rotates pursuant to relative movement of the stylus electrode, and hence resistance to catching of the needle portions is small, and the possibility of the stylus electrode being bent is considerably low.

The non-rotational slidably-contacting member is supported by the movable body so as to be movable toward the axially-rotational slidably-contacting member and non-rotatable, and the axially-rotational slidably-contacting member is supported by a bearing section of the movable body so as to be axially rotatable. In this case, a load is exerted on the non-rotational slidably-contacting member, and an urging load is not exerted directly on the axially-rotational slidably-contacting member. Hence, the bearing section for supporting the axially-rotational slidably-contacting member in an axially-rotatable manner does not need to be provided with another member for eliminating an obstruction to rotation of the axially-rotational slidably-contacting member, which is more effective for curtailing the number of components.

When the corona discharger is embodied as a charging device for charging a surface of the photosensitive drum constituting the image-forming process section, a further increase arises in the suitability of the corona discharger as a cleaning device of the charging device in which the stylus electrode is susceptible to adhesion of toner, paper dust, silicon, or the like.

Other features, elements, processes, steps, characteristics and advantages of the present invention will become more apparent from the following detailed description of preferred embodiments of the present invention with reference to the attached drawings.

DETAILED DESCRIPTION OF PREFERRED EMBODIMENTS

Figure 1:
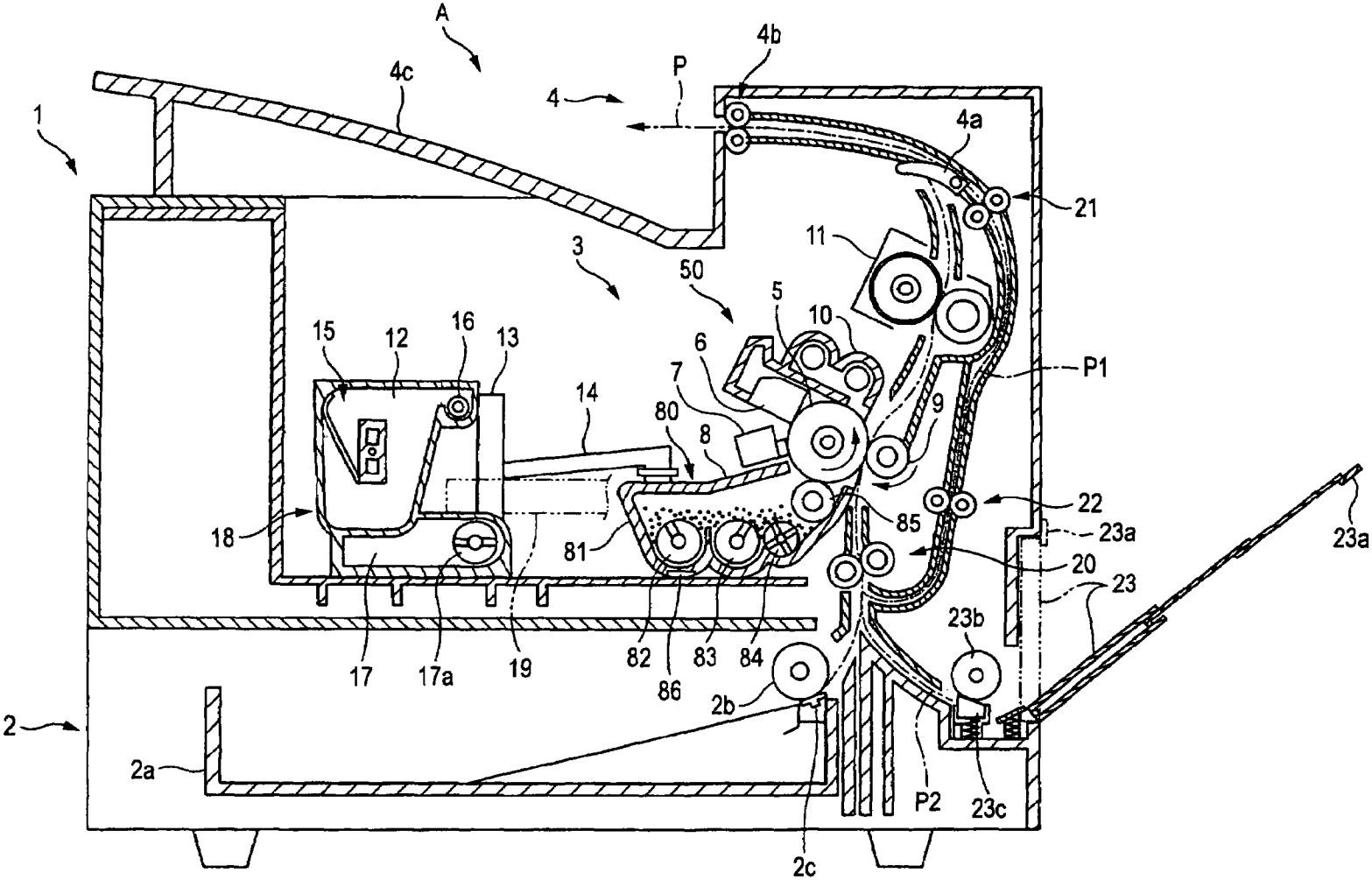
FIG. 1 is a schematic longitudinal cross-sectional view showing an image forming apparatus according to a preferred embodiment of the present invention.
Figure 2:
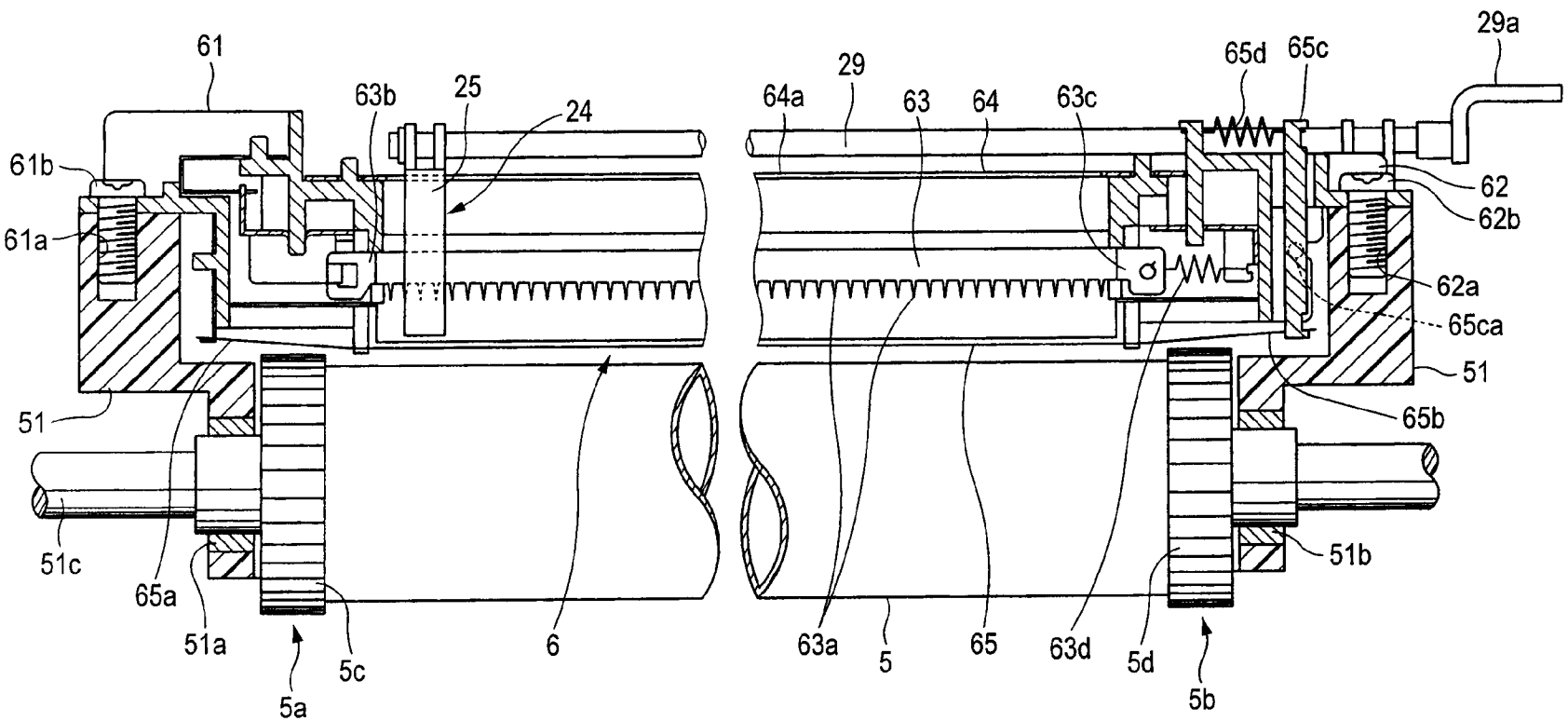
FIG. 2 is a longitudinal cross-sectional view of a drum unit in the image forming apparatus.
Figure 3:
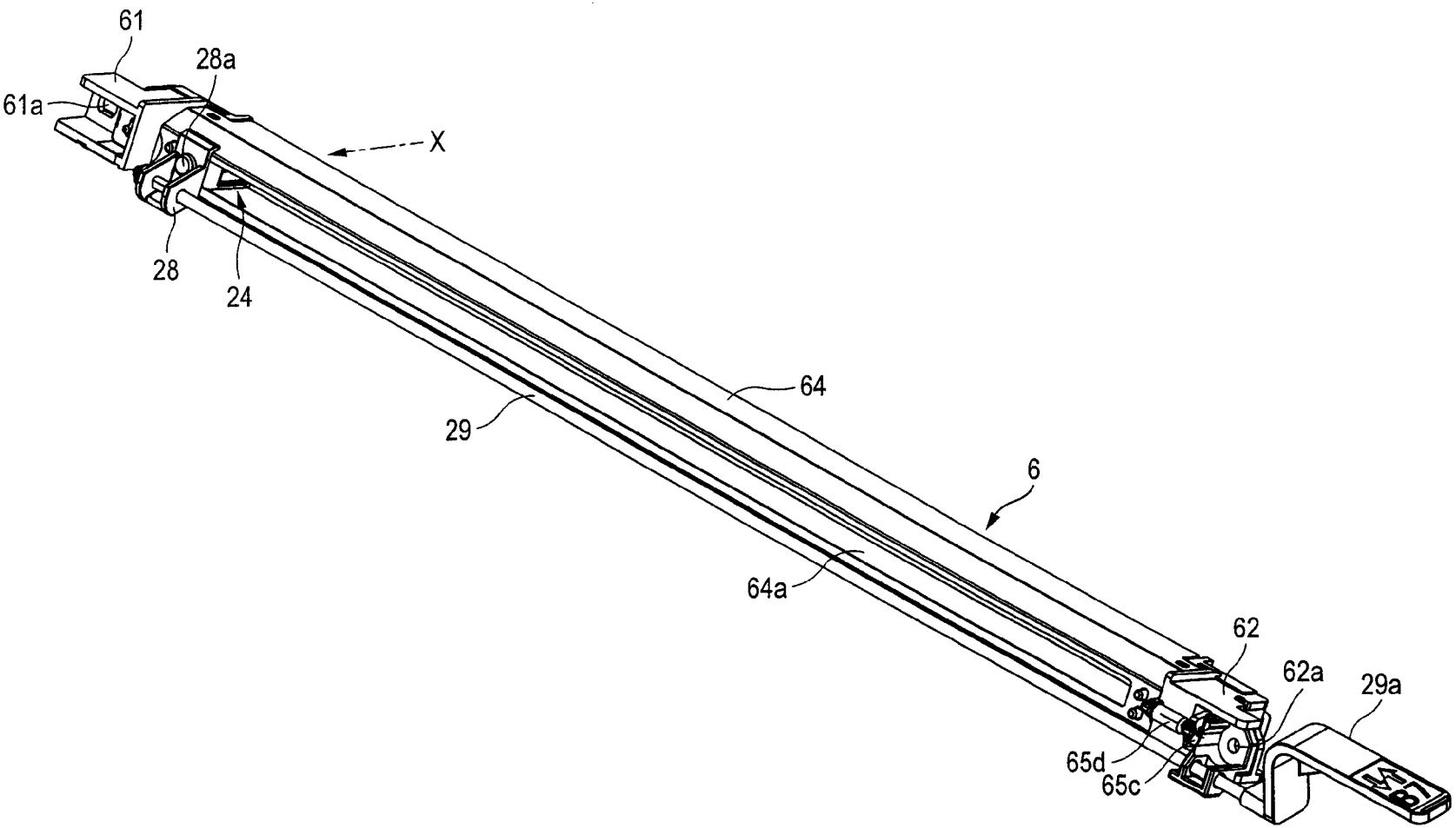
FIG. 3 is a perspective view of a charging device incorporated in the image forming apparatus.
Figure 4:
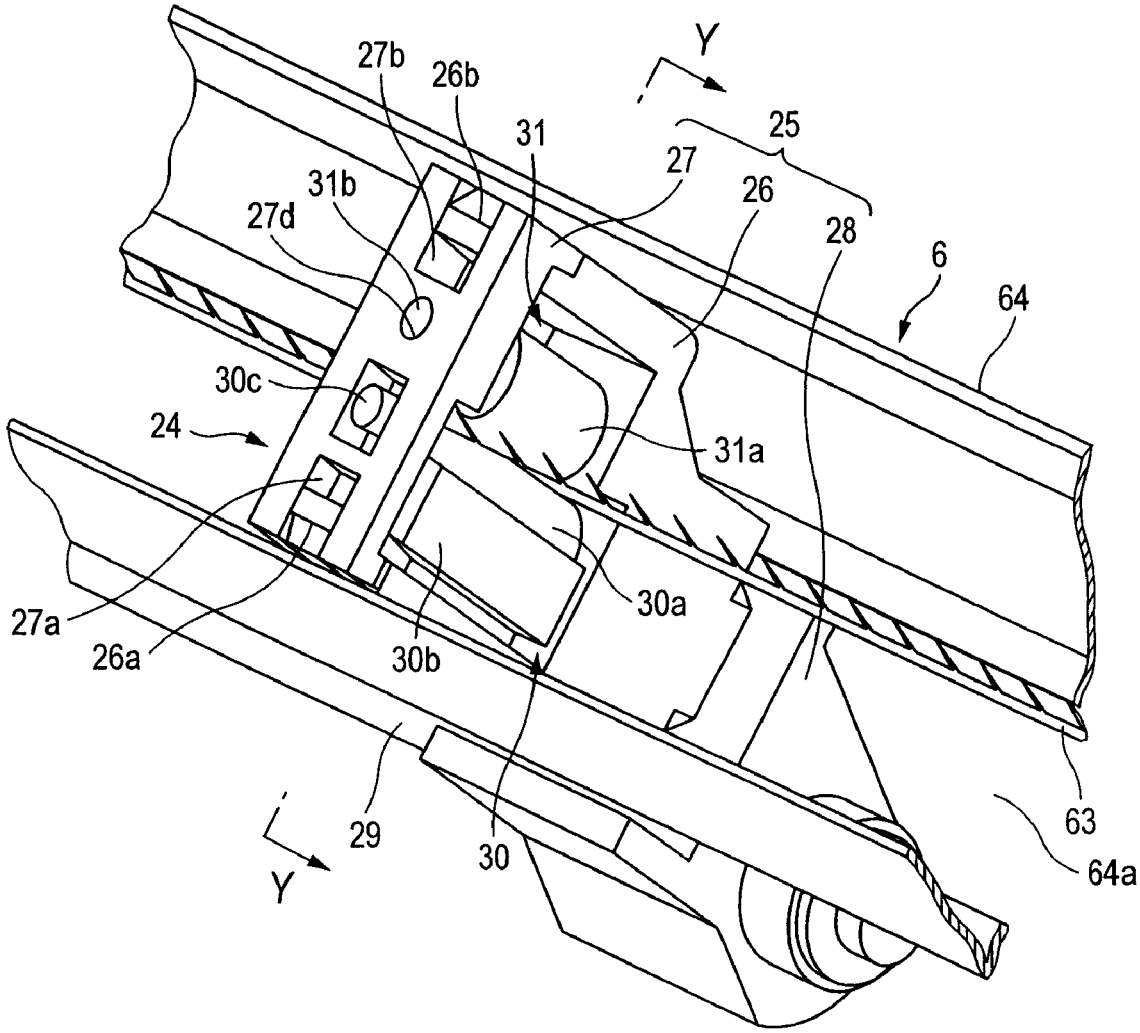
FIG. 4 is a partially-broken perspective view of the charging device when viewed in a direction of arrow X in FIG. 3.
Figure 5:
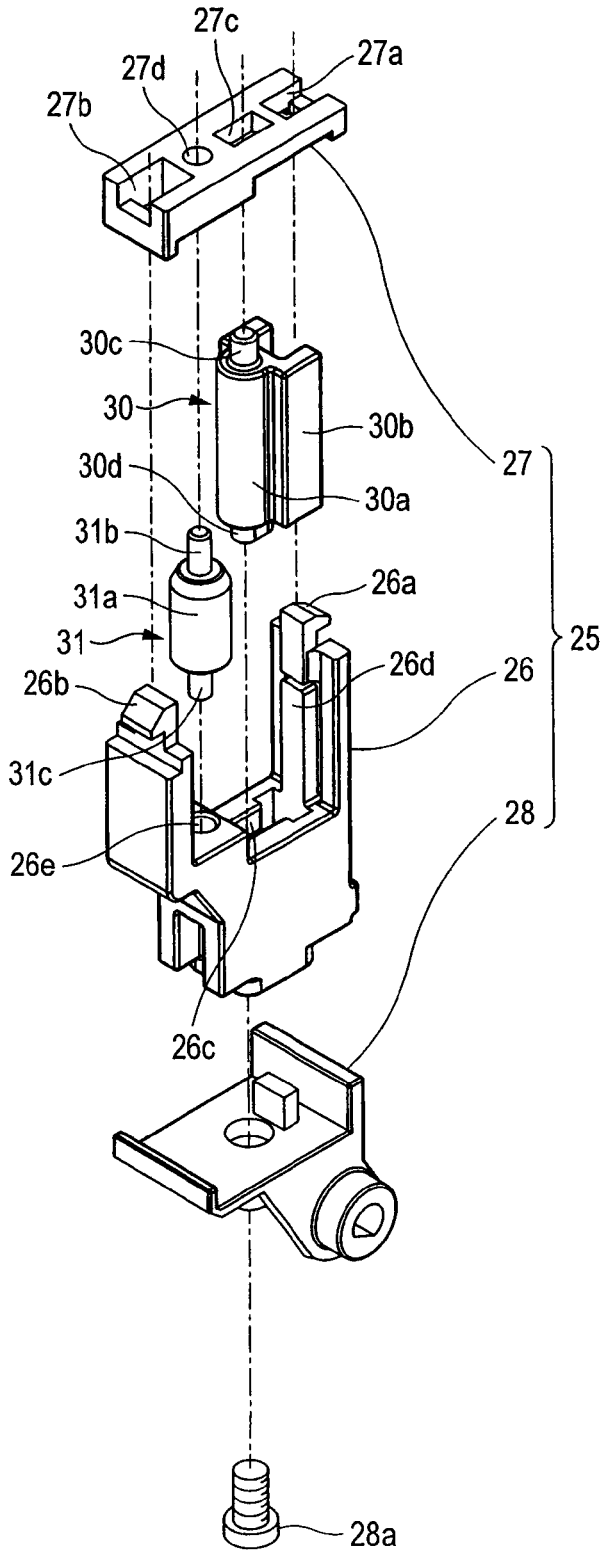
FIG. 5 is an exploded perspective view of a cleaning member attached to the electrifying device.
Figure 6:
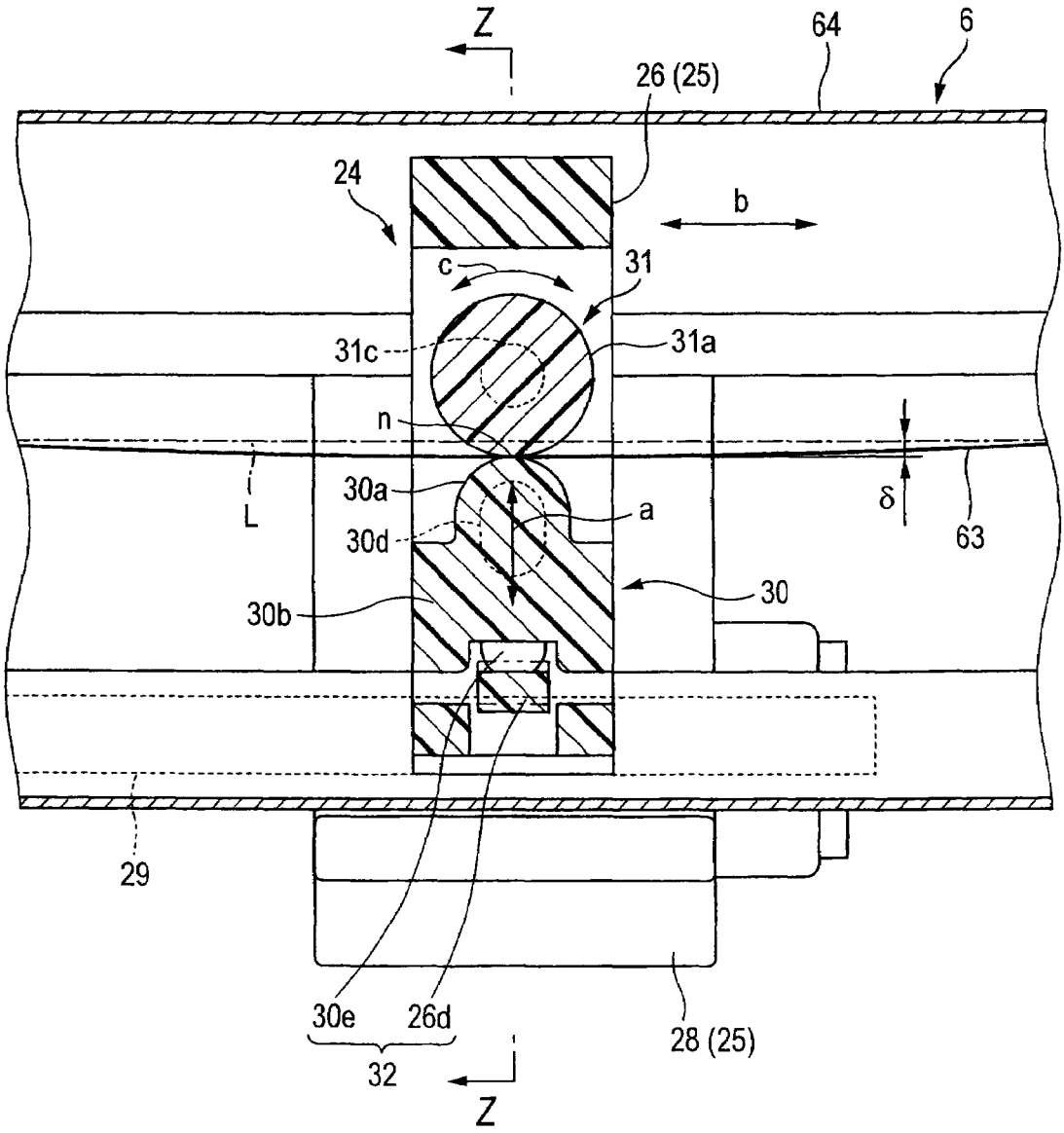
FIG. 6 is a cross-sectional view of the charging device taken along line Y-Y shown in FIG. 4.
Figure 7:
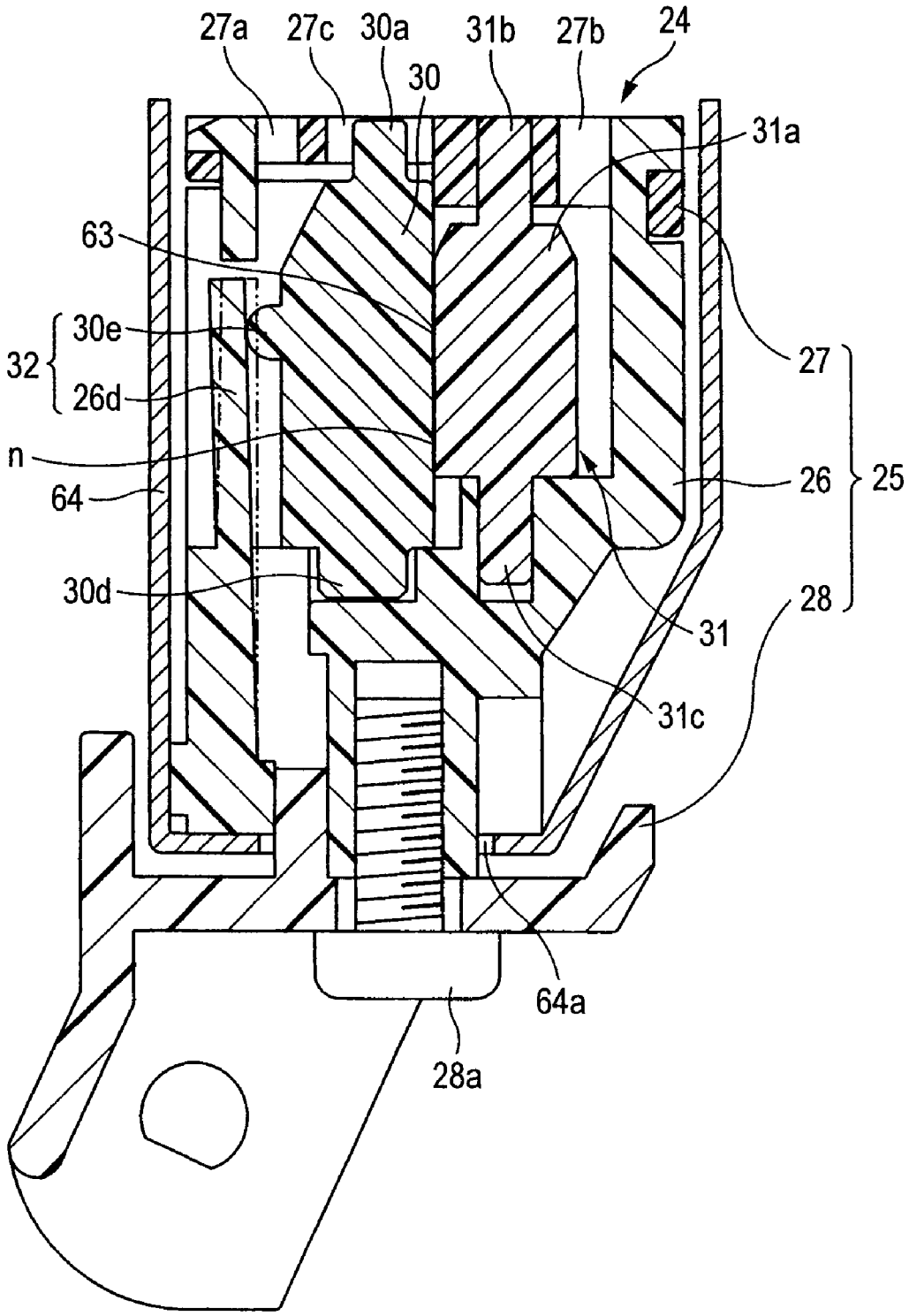
FIG. 7 is a cross-sectional view of the electrifying device taken along line Z-Z shown in FIG. 6.

The best mode for practicing the present invention will be described hereunder by reference to preferred embodiments and the drawings. FIG. 1 is a schematic longitudinal cross-sectional view showing an image forming apparatus according to a preferred embodiment of the present invention; FIG. 2 is a longitudinal cross-sectional view of a drum unit in the image forming apparatus; FIG. 3 is a perspective view of an electrifying device incorporated in the image forming apparatus; FIG. 4 is a partially-broken perspective view of the electrifying device when viewed in a direction of arrow X in FIG. 3; FIG. 5 is an exploded perspective view of a cleaning member attached to the electrifying device; FIG. 6 is a cross-sectional view of the electrifying device taken along line Y-Y shown in FIG. 4; and FIG. 7 is a cross-sectional view of the electrifying device taken along line Z-Z shown in FIG. 6.

An image forming apparatus A shown in FIG. 1 preferably is a printer equipped with an electrophotographic recording section as an example. The image forming apparatus A is not limited to the printer but may also be applied to a copier equipped with an image reader, a facsimile, a so-called multifunction machine having their features, and the like. In the drawings, a main body 1 of the image forming apparatus A preferably includes a recording sheet (paper) sheet feeding section 2, an electrophotographic image recording section 3, and a printed recording sheet discharge section 4 which are stacked in this sequence into layers in a height direction. The recording sheet feeding section 2 preferably includes a sheet feeding cassette 2*a* which can stack a plurality of recording sheets and which can be removably inserted; a separating sheet feeding roller 2*b* disposed at the front end of the sheet feeding cassette 2*a* in a sheet-feeding direction; and a separation pad 2*c* resiliently contacting a circumferential surface of the separating sheet feeding roller 2*b*.

Similar cassettes may additionally be stacked under the sheet feeding cassette 2*a*, to thus constitute a multilayer cassette. Alternatively, the sheet feeding cassette can also be constituted so that an optional cassette (not shown) can be placed. Further, a retard roller can also be used instead of the separation pad 2*c*.

The image recording section 3 preferably includes a process section and a fuser 11 located downstream thereof, wherein, in the process section, a charging device of corona electrification type (a corona electrifying device) 6, an exposure device 7 formed from an LED or the like, a developing device 8, a transfer roller (a transfer device) 9, and a cleaning device 10 for removing toner left after transfer operation are arranged, in this order, around the photosensitive drum 5. The process section except the exposure device 7 and the transfer roller 9 is embodied as a process unit including a drum unit 50, into which the photosensitive drum 5, the electrifying device 6, and the cleaning device 10 are assembled, and a developing device unit 80 into which a development device housing 81, agitation transport screws 82 and 83, a supply paddle 84, a developing roller 85, and others are assembled.

The illustrated developing device unit 80 is a development device using a two-component developing agent, and is configured so as to accommodate toner and carrier in the development device housing 81 acting also as a developing agent container molded from a resin and to supply the developing agent to the development roller 85 biased by the supply paddle 84 while transporting the developing agent in an agitated manner via two parallel agitation transport screws 82 and 83. A magnetic sensor 86 is attached to an exterior surface of the development device housing 81, to thus detect the concentration of toner in the developing device housing 81 (a mixing ratio between toner and a carrier). A toner tank 12 serving as a toner housing section and a toner hopper 13 are disposed at positions separated from the developing device unit 80. When a decrease in the concentration of toner in the developing device housing 81 is detected by the magnetic sensor 86, the development device housing 81 is replenished with toner by way of the toner hopper 13 and a screw conveyor (a pipe screw) 14. An agitator 15 for agitating toner and a screw 16 for transporting and discharging toner to the toner hopper 13 are provided in the toner tank 12. The toner tank 12 equipped with the agitator 15 and the screw 16 is integrated with a wasted toner tank 17 to be described later, to thus become constituted as a toner cartridge 18 removably attached to the main body 1.

The drum unit 50 and the developing device unit 80 are removably attached to the main body 1 from the front of the main body 1 on an individual basis or in the manner of being coupled via any coupling unit. Further, all of the process sections except the exposure device 7 and the transfer roller 9 can also be assembled into a process unit. Moreover, the toner cartridge 18 is also removably attached to the main body 1 from the front of the main body 1. The process units 50, 80 and the toner cartridge 18 are replaced as consumables with new parts, as necessary. The front side of the main body 1 is referred to as a proximal side in the drawing sheet of FIG. 1, and the sheet feeding cassette 2*a* is also removably attached to the main body 1 from the front of the main body 1.

The wasted toner tank 17 constituting the toner cartridge 18 is connected to a screw conveyor 19 for consecutively filling wasted toner removed and recovered by the cleaning device 10. Wasted toner output and filled from a wasted toner discharge port of the conveyor is deposited in a dispersed manner in the wasted toner tank 17 via a transport screw 17*a* provided in the wasted toner tank 17.

A switching gate 4*a*, a pair of discharge rollers 4*b*, and a discharge tray 4*c* are disposed, in an interconnected manner, downstream of the fuser 11, thereby constituting the discharge section 4. A pair of registration rollers 20 are disposed in the vicinity of an upstream-side of the process section. A recording sheet (paper) separately fed one at a time from the sheet feeding cassette 2*a* via action of the separating sheet feeding roller 2*b* and the action of the separation pad 2*c* is registered by the pair of registration rollers 20. The thus-registered sheet is guided to a mutually-facing section between the photosensitive drum 5 and the transfer roller 9. The surface of the photosensitive drum 5 is uniformly charged negatively by the charging device 6 while the drum 5 is rotating in an arrowed direction in FIG. 1. An optical image based on image information is radiated onto the surface of the photosensitive drum 5 via the exposure device 7, whereupon an electrostatic latent image is formed on the surface of the photosensitive drum 5. The electrostatic latent image is formed as a result of electric potentials of exposed areas changing according to a characteristic of a photoconductor provided on the surface of the photosensitive drum 5 and an electric potential of remaining areas being maintained.

The electrostatic latent image is consecutively developed by the biased developing device 8, and the thus-developed image reaches, as a toner image, to the mutually-facing section between the photosensitive drum 5 and the transfer roller 9. At the time of development, toner is attracted by the photosensitive drum 5 via a potential difference between the drum and the developing device 8, whereby the areas whose electric potentials are changed upon exposure turn into black areas. Toner is not attracted by the other areas, and hence the areas remain white areas. As a whole, a black-and-white toner image based on the image information is formed. The pair of registration rollers 20 is registration-controlled and rotationally driven in such a way that the recording sheet is guided into the mutually-facing section in synchronism with the toner image on the surface of the photosensitive drum 5.

The transfer roller 9 remains biased; is caused to face the photosensitive drum 5; and transports the recording sheet in a nipping manner while being rotationally driven in an arrowed direction (the same direction where the photosensitive drum 5 rotates), whereby the toner image on the surface of the photosensitive drum 5 is transferred to the recording sheet. Toner (including paper dust in some occasions) still remaining on the surface of the photosensitive drum 5 is eliminated and recovered by the cleaning device 10. The recording sheet on which the toner image is transferred is guided to the fuser 11, where the image is fused as a permanent image. Subsequently, the recording sheet raises the switching gate 4*a* and is discharged onto the discharge tray 4*c* via the pair of discharge rollers 4*b*. A series of operations for feeding the recording sheet are performed via a main feeding path P along which a sheet ascends essentially perpendicularly (in a vertical direction) immediately after being fed by the sheet feeding cassette 2*a* and makes, at the pair of discharge rollers 4*b*, an essentially 180-degree U-turn with respect to the direction in which the sheet is fed from the sheet feeding cassette 2*a*. With such a unique layout, the entirety of the image forming apparatus is miniaturized.

The image forming apparatus A of the illustrated preferred embodiment preferably has a duplex recording function, and there is formed an inverse feed path P1 which extends from a position where the switching gate 4*a* of the main feed path P is attached and which merges, in a circulating manner, with the main feed path P at a position upstream of the pair of registration rollers 20. The pair of discharge rollers 4*b* are rotatable forwardly/backwardly, and a pair of transport rollers 21, 22 are provided along the inverse feed path P1. When duplex recording is performed, a recording sheet printed only one side is transported along the main feed path P. When a trailing end of the recording sheet has reached the pair of discharge rollers 4*b*, the pair of discharge rollers 4*b* are temporarily stopped, and the trailing end of the recording sheet is nipped. Subsequently, the pair of discharge rollers 4*b* rotate backwardly, and the pair of transport rollers 21, 22 transports the recording sheet to the inverse feed path P1 by utilization of the trailing end of the recording sheet. The thus-transported recording sheet merges with the main feed path P, to thus reach the pair of registration rollers 20. The recording sheet is registered via the pair of registration rollers 20 and again guided to the mutually-facing section between the photosensitive drum and the transfer roller 9, whereupon the back of the recording sheet is subjected to recording. The recording sheet having undergone double-sided recording is subsequently discharged onto the discharge tray 4*c* along the main feed path P in the same manner as mentioned previously.

The image forming apparatus A of the illustrated example also has a function for manually feeding a recording sheet, and a manual sheet feeding tray 23, which can open and close in the vertical direction and slidably extend and contract in three steps, is attached to the side of the main body 1. When not used, the manual sheet feeding tray 23 is closed in a contracted state as indicated by a two-dot chain line in FIG. 1. When used, the manual sheet feeding tray 23 is opened by use of a grip 23*a*, and the tray is extended appropriately in conformance with the size of the recording sheet placed for sheet feeding purposes. A manual-feeding separation sheet-feeding roller 23*b* and a separation pad 23*c* are disposed, in an elastically-contacting manner, at the front end of the manual feeding tray 23. A manual feed path P2 with which the main feed path P merges is continuously provided at a position downstream of the roller 23*b* and the pad 23*c*.

The toner hopper 13 is provided for temporarily storing toner supplied from the toner tank 12. When the magnetic sensor 86 of the development device 8 transmits a toner empty signal, the screw conveyor 14 linked to the toner hopper 13 is activated, and toner is supplied to the inside of the development device housing 81. Operation of the screw 16 for the purpose of transporting or discharging toner is controlled by a detection signal from a sensor (not shown) provided in the toner hopper 13 such that a predetermined quantity of toner is preserved in the toner hopper 13 at all times. The toner of predetermined quantity preserved in the toner hopper 13 is set to a quantity which is sufficient for enabling continued printing operation from when the toner in the toner tank 12 has become depleted until replacement of the toner cartridge to a new toner cartridge 18.

Next, the photosensitive drum unit 50 integrally provided with the charging device 6 will be described in detail by reference to FIG. 2. In the photosensitive drum 5, the surface of a conductive cylindrical element, such as aluminum, is coated with a photoconductor, and flange members 5*a* and 5*b* made from an insulating resin or the like are fixed to openings at both ends of the cylindrical element. In the photosensitive drum 5, a single shaft (drum shaft) 51*c* is coaxially inserted to the flange members 5*a* and 5*b* provided at both ends of the drum; and supported, in an axially-rotatable manner, by a unit frame 51 made from a resin-molded article via bearings 51*a* and 51*b*. A gear 5*c* is concentrically formed in the peripheral surface of the flange member 5*a*, and a gear 5*d* is concentrically formed in the peripheral surface of the flange member 5*b*. The gear 5*c* is joined, in an engaged manner, to an unillustrated drive transmission system in the main body 1, and the photosensitive drum 5 is axially rotated around a drum shaft 51*c* via a drive force supplied from the drive transmission system. The gear 5*d* placed opposite to the gear 5*c* engages with driven transmission gears of mechanism sections, such as the transfer roller 9, (both of them are unillustrated), whereby a rotational driving force is transmitted to these mechanism sections.

The charging device 6 is formed from a corona discharging device preferably of a scorotoron type. The charging device 6 preferably includes a pair of attachment member 61 and 62, a stylus electrode 63, a shield case (case section) 64 and grid 65. These members 61, 62, 63, 64 and 65 preferably are unitized. The pair of attachment members 61 and 62 is fixedly attached to both ends of the unit frame 51. The stylus electrode 63 is stretched between the mount members 61 and 62. The shield case (case section) 64, which is coupled and supported between the mount members 61 and 62, covers the stylus electrode 63, and preferably has a substantially U-shaped cross section. The grid 65 is disposed on an opening of the photosensitive-drum side of the shield case 64 stretched between the mount members 61 and 62. The mount members 61 and 62 are fixedly fastened to the unit frame 51 via machine screws 61*b* and 62*b* via screw holes 61*a* and 62*a* formed in the respective mount members 61 and 62.

The stylus electrode 63 is an electrode for corona electric discharge and formed from an element like a metal strip having a plurality of needle-shaped electrodes 63*a*, 63*a*, . . . , such as those illustrated. One end 63*b* of the stylus electrode 63 is latched to the inside of one attachment member 61, and the other end 63*c* is latched to the inside of the other mount member 62 by a tension spring 63*d*. The stylus electrode 63 is stretched between the mount members 61 and 62 in a tensioned manner. The grid 65 is formed from a thin metal plate in which a plurality of slits are formed, and one end 65*a* of the grid 65 is latched to one of the mount member 61, and the other end 65*b* is latched to the other mount member 62 via a swayable section piece 65*c* and a tension spring 65*d*.

The swayable section piece 65*c* is arranged so as to penetrate through the mount member 62 from a side thereof facing the photosensitive drum 5 to the other side of the same and is supported so as to be able to swing around a support pin 65*ca*. The other end 65*b* of the grid 65 is latched to a projecting end of the swayable section piece 65*c* facing the photosensitive drum 5, and a tension spring 65*d* is latched to a projecting end on the other side of the swayable section piece. When the photosensitive drum unit 50 is attached to a predetermined location in the image forming apparatus A, the stylus electrode 63 and the grid 65 are connected to power electrodes (not shown) of the main body 1. Thus, predetermined voltages are applied to the power electrodes. The mount members 61 and 62 and the shield case 64 are integrally connected together.

The charging device 6 has a cleaning member 24 which has the stylus electrode 63 inserted therein and which can slidably move over the charging device 6 along a longitudinal direction thereof. As shown in FIGS. 2 through 7, the cleaning member 24 has a movable body 25 attached to the shield case 64 so as to be reciprocally movable along the longitudinal direction of the stylus electrode 63; two slidably-contacting members 30 and 31 which are supported by the movable body 25 and between which the stylus electrode 63 is inserted; and an urging unit 32 interposed between the movable body 25 and the slidably-contacting member 30 so as to be elastically urging one slidably-contacting member 30 toward the other slidably-contacting member 31. The movable body 25 preferably has a substantially C-shaped movable-body main body 26 for holding two slidably-contacting members 30 and 31; a press member 27 for pressing, in a non-detachable manner, the slidably-contacting members 30 and 31 supported by the movable-body main body 26; and a mount section piece 28 which is fixed to the back of the movable-body main body 26 via a machine screw 28*a* and which is used for attaching the movable body 25 to the extremity of an operation rod 29. The movable-body main body 26 and the mount section piece 28 are fixed together via the machine screw 28*a* so as to penetrate through an opening 64*a*, which is formed in the back of the substantially U-shaped shield case 64 in a longitudinal direction thereof, and to straddle the opening widthwise with a brim of the opening sandwiched therebetween. The movable-body main body 26 and the mount section piece 28 can move, in an integrated fashion, within the opening 64*a* along the longitudinal direction of the shield case 64 (the stylus electrode 63).

Both leg sections of the movable-body main body 26 is elastically deformable, and latch claws 26*a* and 26*b* are formed at extremities of both leg sections. The latch claws 26*a* and 26*b* are inserted and latched to the press member 27 via latch holes 27*a* and 27*b* formed in the press member 27. As a result, the press member 27 is attached to the movable-body main body 26 so as to retain, in a non-detachable manner, the two slidably-contacting members 30 and 31 held in predetermined positions as will be described later.

The one slidably-contacting member 30 preferably includes a non-rotational slidably-contacting member which is supported by the movable-body main body 26 so as to be movable toward the other slidably-contacting member 31 and to be non-rotatable. In more detail, the non-rotational slidably-contacting member 30 preferably includes a slidably-contacting section 30*a* having a substantially semi-circular cross section, a base section 30*b* which is formed integrally with the back of the slidably-contacting section 30*a* along the longitudinal direction and which assumes a concave cross-sectional profile, and latch pins 30*c* and 30*d* formed at both longitudinal ends of the slidably-contacting member. When the non-rotational slidably-contacting member 30 is attached to and held by the movable body 25, the latch pins 30*c* and 30*d* provided at both ends of the slidably-contacting member are inserted into an elongated hole 26*c* formed in the movable-body main body 26 and an elongated hole 27*c* formed in the press member 27. The longitudinal directions of the respective elongated holes 26*c* and 27*c* are oriented in a mutually-opposing direction of the two slidably-contacting members 30 and 31, whereby the non-rotational slidably-contacting member 30 becomes movable along the mutually-opposing direction (refer to the direction of arrow "a" in FIG. 6) in the above-described attached and held state.

The base section 30*b* is engaged so as to enclose, within a recess thereof, the base section of the latch claw 26*a* and an elastic section piece 26*d* that is arranged, in a cantilever fashion, at one leg section of the movable-body main body 26. Through engagement of the elongated-circular latch pin 30*d* with the elongated hole 26*c*, the non-rotational slidably-contacting member 30 becomes axially-non-rotatable in the attached and held state. A projection 30*e* is formed on an interior surface of the recess of the base section 30*b* . In the attached and held state, the projection 30*e* contacts the elastic section piece 26*d*, to thus elastically deform the elastic section piece 26*d* from the position indicated by the two-dot chain line to a position indicated by a solid line shown in FIGS. 6 and 7. Through the elastic restoration force, the elastic section piece 26*d* acts so as to elastically urge the non-rotational slidably-contacting member 30 toward the other axially-rotatable slidably-contacting member 31, whereupon the biasing unit 32 is constituted.

The axially-rotatable slidably-contacting member 31 preferably includes a roller member 31*a* having a circular or substantially circular cross-sectional profile and rotational support shafts 31*b* and 31*c* coaxially arranged at both longitudinal ends of the roller member. Shaft holes 26*e* and 27*d*, which serve as bearing sections, are formed in the movable-body main body 26 and the press member 27, respectively. In a state where the axially-rotatable slidably-contacting member 31 is attached to and held by the movable body 25, the rotational support shafts 31*b* and 31*c* are axially supported by the shaft holes 26*e* and 27*d*, whereby the axially-rotatable slidably-contacting member 31 is arranged to be rotatable around the rotational support shafts 31*b* and 31*c*. The two slidably-contacting members 30 and 31 are attached to and held by the movable-body main body 26 and the press member 27 in such a way that the stylus electrode 63 of the charging device 6 is sandwiched between the two slidably-contacting members 30 and 31. The two slidably-contacting members 30 and 31 are attached to the shield case 64 via the attach section piece 28 joined to the extremity of an operation rod 29. As a result, the cleaning member 24 capable of moving along the longitudinal direction of the stylus electrode 63 is constructed. It is desirable that respective constituent sections of the two slidably-contacting members 30 and 31 and the movable body 25 be formed from a resin into an integrally-molded piece.

As shown in FIG. 6, a nip section "n" between the two slidably-contacting members (the non-rotational slidably-contacting member and the axially-rotatable slidably-contacting member) 30, 31 is arranged so as to become slightly closer to the non-rotational slidably-contacting member 30 with reference to a tension line L of the stylus electrode 63. Therefore, as will be described later, when the movable body 25 is reciprocally actuated, to thus clean the stylus electrode 63 via the cleaning member 24, the slidably-contacting members 30 and 31 perform slidable motion such that the stylus electrode 63 is gently deflected at the nip section "n." The amount of deviation δ from the tension line L of the nip section "n" toward the non-rotational slidably-contacting member 30 is set in such a way that sliding resistance of the slidably-contacting members 30 and 31 does not become excessive.

The way to clean the stylus electrode 63 in the charging device 6 equipped with the above-configured cleaning member 24 will now be described. As shown in FIGS. 2 and 3, an operation grip section 29*a* is formed on a base section of the operation rod 29 (on a side of the operation rod facing an unillustrated reclosable door for maintenance purpose provided in the main body 1). An operator opens the reclosable door, to thus grip the operation grip section 29*a* and repeat push-and-pull operation. Through the push-and-pull operation, the cleaning member 24 repeats reciprocal movement on the stylus electrode 63 along the longitudinal direction thereof as indicated by the arrow "b" shown in FIG. 6. During the period of reciprocal movement, the stylus electrode 63 is sandwiched between the two slidably-contacting members 30 and 31. Hence, adhering toner, paper dust, silicon, or the like, are wiped away by the slidably-contacting action of the slidably-contacting members 30 and 31. Through the action of the urging unit 32, the urging force is exerted on the non-rotational slidably-contacting member 30 in the direction of arrow "a," whereby the stylus electrode 63 is elastically sandwiched between the two slidably-contacting members 30 and 31. Thus, wiping removal is effectively performed.

During reciprocal movement in an elastically-urged state, the axially-rotatable slidably-contacting member 31 axially rotates as indicated by arrow "c" shown in FIG. 6 pursuant to relative movement of the stylus electrode 63. As a result, the cleaning member 24 is smoothly moved in a reciprocating manner. Since the axially-rotatable slidably-contacting member 31 does not directly undergo an elastic urging load, rotation of the member 31 is not impeded by the load. In the non-rotational slidably-contacting member 30, the semicircular slidably-contacting section 30*a* elastically, slidably moves over the stylus electrode 63 while being urged toward the axially-rotatable slidably-contacting member 31 at all times. A curved portion of the slidably-contacting section 30*a* acts as a surface which slidably contacts the stylus electrode 63, and hence elastic, slidable movement is also performed with very little, if any, resistance. The function of such a cleaning member 24 is attained without the use of a bearing member for receiving a load, or the like, which is effective for a reduction in the number of components.

Since the nip section "n" between the slidably-contacting members 30 and 31 is close toward the non-rotational slidably-contacting member 30 by the amount of deviation δ from the tension line L of the stylus electrode 63, the needle-shaped electrodes 63*a* . . . (see FIG. 2) of the stylus electrode 63 are guided from the axially-rotational slidably-contacting member 31 to the nip section "n" during sliding action of the slidably-contacting members 30 and 31. Accordingly, the degree of contact of the needle-shaped electrodes 63*a* with the slidably-contacting section 30*a* of the non-rotational slidably-contacting member 30 becomes smaller, and the possibility of the needle-shaped electrodes 63*a*, 63*a*, . . . , being caught on the surface of the slidably-contacting section 30*a* is decreased. As a result, the possibility of the stylus electrode 63 being bent by a catch is also lessened. Moreover, the possibility of the stylus electrode 63 being guided to the nip section "n" from the axially-rotational slidably-contacting member 31 is enhanced. However, since the axially-rotatable slidably-contacting member 31 axially rotates pursuant to relative movement of the stylus electrode 63, catching resistance of the needle-shaped electrodes 63*a*,63*a*, . . . , etc., is small, and the possibility of bending of the stylus electrode 63 is considerably low.

While the present invention has been described with respect to preferred embodiments thereof, it will be apparent to those skilled in the art that the disclosed invention may be modified in numerous ways and may assume many embodiments other than those specifically set out and described above. Accordingly, it is intended by the appended claims to cover all modifications of the present invention that fall within the true spirit and scope of the present invention.

What is claimed is:

1. An image forming apparatus comprising:

a corona discharger including:

a case section;

a stylus electrode stretched within the case section, the stylus electrode including a metal strip having a plurality of needle-shaped electrodes; and a cleaning member arranged to slidably move along a longitudinal direction of the stylus electrode such that the stylus electrode is sandwiched in the cleaning member;

wherein the cleaning member includes:

a movable body attached to the case section of the corona discharger so as to be movable along the longitudinal direction of the stylus electrode;

a combination of a non-rotational slidably-contacting member and an axially-rotational slidably-contacting member which are respectively supported by the movable body between which the stylus electrode is sandwiched; and an urging unit interposed between the movable body and the non-rotational slidably-contacting member so as to elastically urge the non-rotational slidably-contacting member toward the axially-rotational slidably-contacting member; and positions of the two slidably-contacting members are set in such a way that a nip section between the two slidably-contacting members is closer to the non-rotational slidably-contacting member with reference to a tension line of the stylus electrode;

the non-rotational slidably-contacting member is supported by the movable body so as to be movable toward the axially-rotational slidably-contacting member and non-rotatable; and the axially-rotational slidably-contacting member is supported by a bearing section of the movable body so as to be axially rotatable around a rotational support shaft arranged parallel to a surface of the stylus electrode.

2. The image forming apparatus according to claim 1, further comprising a photosensitive drum, wherein the corona discharger is a charging device for charging a surface of the photosensitive drum.

* * * * *